US006102020A

United States Patent [19]

Mizek et al.

[11] Patent Number: 6,102,020

[45] Date of Patent: Aug. 15, 2000

[54] SLOW RETURN ARROWREST

[75] Inventors: Robert S. Mizek, Downers Grove; Miroslav A. Simo, Riverside; Frank A. Harwath, Downers Grove, all of Ill.

[73] Assignee: New Archery Products Corp., Forest Park, Ill.

[21] Appl. No.: 09/226,502

[22] Filed: Jan. 7, 1999

Related U.S. Application Data

[60] Provisional application No. 60/070,822, Jan. 8, 1998.

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,287,868 | 9/1981 | Schiff | 124/44.5 |
| 4,803,971 | 2/1989 | Fletcher | 124/44.5 |
| 4,953,521 | 9/1990 | Troncoso et al. | 124/24.1 |
| 5,117,803 | 6/1992 | Johnson | 124/44.5 |
| 5,150,700 | 9/1992 | Troncoso | 124/44.5 |
| 5,383,441 | 1/1995 | Lightcap | 124/44.5 |
| 5,490,491 | 2/1996 | Troncoso | 124/44.5 |
| 5,722,381 | 3/1998 | Mizek | 124/44.5 |

*Primary Examiner*—John A. Ricci
*Attorney, Agent, or Firm*—Pauley Petersen Kinne & Fejer

[57] ABSTRACT

An improved arrowrest is provided having a rate of motion from a first normal position to a second actuated position is greater than the rate of return motion from the second to the first position. An arrowrest is attachable to a support shaft for the arrowrest. The support shaft is moveable between the first position and the second position. As an arrow shaft discharges over the arrowrest, the support shaft moves in one direction with less frictional resistance than in a return direction.

14 Claims, 5 Drawing Sheets

SLOW RETURN ARROWREST

CROSS REFERENCE TO RELATED APPLICATION

This application claims the benefit of U.S. Provisional Application No. 60/070,822, filed Jan. 8, 1998, the disclosure of which earlier application is hereby incorporated by reference herein and made a part hereof, including but not limited to those portions which specifically appear hereinafter.

BACKGROUND OF THE INVENTION

This invention relates to an improved arrowrest adapted for use in association with an archery bow.

In an archery bow, an arrow is normally suspended within a cutout in a bow riser atop an arrowrest, such as on the support arms thereof. Many conventional arrowrest mounting apparatuses allow the arrowrest to rotate or pivot forward, in a direction away from a discharged arrow shaft, and also cause the arrowrest to immediately return to an original set position by applying a return bias force either directly or indirectly to the arrowrest. For example, such arrowrests commonly employ a spring bias. Such spring bias typically may be either in the vertical or horizontal plane and may either have an adjustable or fixed spring rate. Arrowrests of this type have been known to those skilled in the art for some time.

FIG. 1 illustrates one form of arrowrest and associated mounting apparatus, as is know in the art. More specifically, the arrowrest A is fastened or otherwise mounted on a rotatable support shaft S and joined to an associated mounting bracket B. In FIG. 1, the arrowrest A is shown in solid line form in a first or normal position and in phantom in a second or actuated position.

Commonly assigned Mizek, U.S. Pat. No. 5,722,381, issued Mar. 3, 1998, the disclosure of which is fully incorporated herein by reference, discloses an improved apparatus for adjustably mounting a pivotal arrowrest.

High-speed photography has clearly shown that when an arrow has been fired from a bow, the associated arrowrest is deflected away from the arrow. Such photography also has shown that the arrowrest may return to the "normal" position before the arrow has totally passed the arrowrest. Very commonly, the fletching (e.g., vanes or feathers) strikes the arrowrest with such force that it may result in some deflection or misdirection of the arrow. Such deflection may cause the arrow to strike an object or location other than the intended target. Such deflection may also create premature wear on the fletching such as may necessitate expensive and time-consuming replacement thereof at a point in time sooner than otherwise desired. Lastly, such contact of the arrowrest by the fletching may additionally create undesired noise. As will be appreciated, such noise can be of great concern as such noise may have the undesired effect of scaring game animals when a bow is used for hunting.

Prior attempts to achieve improved arrow clearance during release have met with varying success. For example, prior devices frequently employ arrowrests that are biased as to "fall away" upon the release of the bowstring. Such devices commonly rely on mechanical means to pull the arrowrest out of the way of the associated arrow. As will be appreciated, such mechanical means may undesirably or unacceptably suffer from shortcomings, disadvantages or limitations such as relating to increased complexity, bulkiness, expense or combinations thereof. Some of these prior device utilize changes in inertia to activate the arrowrest return mechanism. However, it is generally undesirable to employ a bow that produces large changes in inertia as an archer may perceive this as recoil.

Thus, there is a need and a demand for an improved arrowrest and, in particular, there is a need and demand for an arrowrest having a return rate of motion that is less than a discharge rate of motion, such as to enable a respective arrow to totally clear the arrowrest before returning to the normal position.

SUMMARY OF THE INVENTION

A general object of the invention is to provide an improved arrowrest.

A more specific objective of the invention is to overcome one or more of the problems described above.

The general object of the invention can be attained, at least in part, through an arrowrest for an archery bow having a first normal position and a second actuated position. In accordance with one embodiment of the invention, such an improved arrowrest has a rate of motion greater from the first to the second position than a rate of return motion from the second to the first position.

The prior art generally fails to provide an arrowrest having a return rate of motion that is less than a discharge rate of motion, such as to enable a respective arrow to totally clear the arrowrest before returning to the normal position in a manner as simple, inexpensive, efficient and effective as may be desired without producing undesirably large changes in inertia.

Other objects and advantages will be apparent to those skilled in the art from the following detailed description taken in conjunction with the appended claims and drawings.

DETAILED DESCRIPTION OF THE INVENTION

The present invention may be embodied in a variety of different improved arrowrest structures such as may be used in association with an archery bow.

Figure 2:
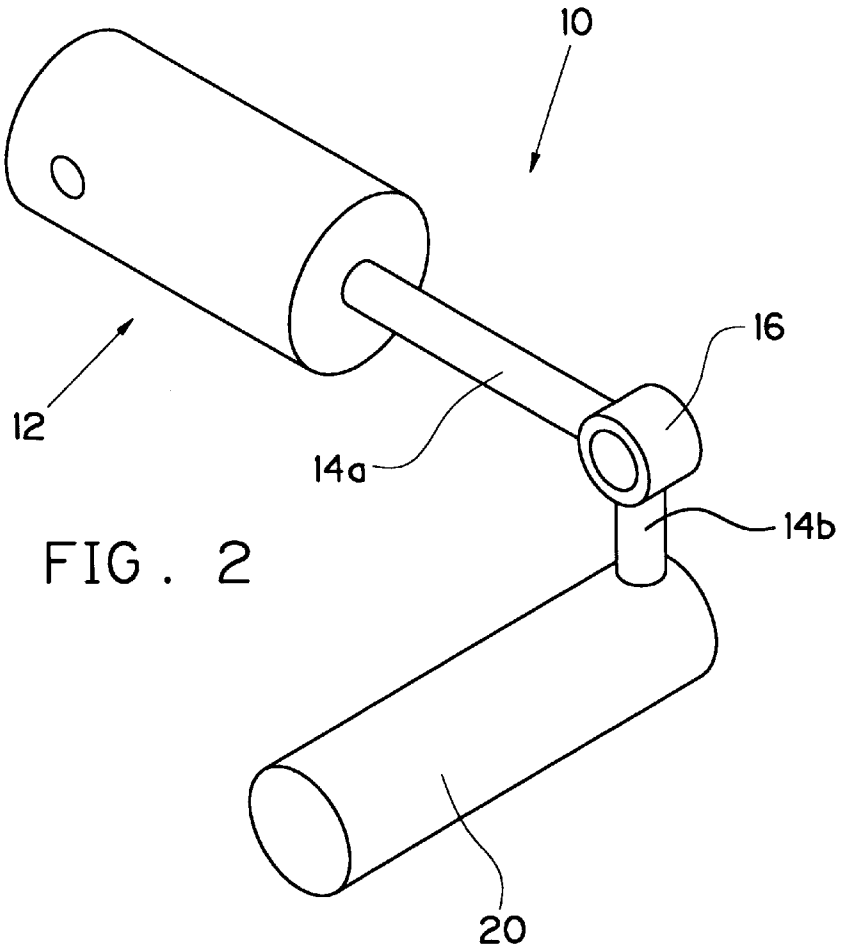
FIG. 2 is a simplified schematic perspective view of arrowrest motion mechanism in accordance with a first preferred embodiment of the invention.

FIG. 2 illustrates an arrowrest motion mechanism, generally designated by the reference numeral 10, in accordance with a first preferred embodiment of the invention. More specifically, the arrowrest motion mechanism 10 employs a linear piston arrangement and includes a piston with reed valve assembly 12 such as attached via attachment arms 14*a* and 14*b*, respectively, and hinge point 16 to a rotatable arrowrest support shaft 20, whereto an arrowrest (not shown) such as known in the art, may be attached in a manner such as also known in the art. For ease of comprehension and clarity, FIG. 2 has been simplified by not showing the associated bracket and spring return such as are known in the art.

In the arrowrest motion mechanism 10 a piston traverses a length within a bore. The bore may be linear (as shown) or circumferential (as described below) in configuration. When the arrowrest is actuated by launching an arrow, the piston correspondingly moves within the bore. For example, the piston may move forward within the bore.

The arrowrest motion mechanism 10 employs a dampening medium, such as air, for example, to dampen the return rate of the arrowrest after actuation. Thus, upon actuation, the dampening medium escapes rapidly from the bore by means of a reed valve or one-way bleeder valve. When the arrowrest changes direction as it attempts to return to the "normal" position, the reed valve or one-way bleeder valve closes, and the flow of dampening medium going back into the bore is correspondingly limited such as either variably or at preset rate.

Alternatively, the arrowrest motion mechanism 10 may provide for the rearward movement of the piston within the associated bore upon actuation of the arrowrest by the launching of an arrow. When the arrowrest changes direction as it attempts to return to the "normal" position, the reed valve or one-way bleeder valve closes, and a valve having either a variable or preset rate limits the flow of air going back into the bore. The rate at which air returns to the bore controls the rate that the arrowrest returns to the normal position.

In accordance with the invention, the arrowrest can be mechanically connected, directly or indirectly, to the piston so that the arrowrest moves as the piston moves. A bias force, such as from a spring element or another bias source (not shown to facilitate illustration), is preferably but not necessarily used to return the arrowrest to the normal position.

As will be appreciated, the rate at which the dampening medium returns to the bore controls the rate that the arrowrest returns to the normal position. While the invention has been described above relative to the use of air as a dampening medium it will be appreciated that the broader practice of the invention is not necessarily so limited. The dampening media for use in the practice of the invention can take the form of a liquid, gas or combination thereof, as may be desired. In general, a liquid offers the advantage that unlike a gas, it is relatively incompressible. A preferred dampening medium for use in the practice of the invention desirably will have the same or similar properties or characteristics over a wide range of temperature and such as may be associated with the use of a corresponding archery bow. In particular, a preferred liquid dampening medium for use in colder environments will constitute or contain alcohol or other selected antifreeze liquid or material having a desirably low freezing point.

The use of air or another suitable gas instead of a liquid form of dampening media offers the advantage that the viscosity of gaseous media is not significantly altered with temperature fluctuations and consequently the dampening rate will remain nearly constant over a broad range of ambient temperatures. In addition, the use of air as a dampening medium advantageously may avoid a requirement for special sealing means to prevent leakage that would adversely affect the functionality of the unit.

Figure 3:
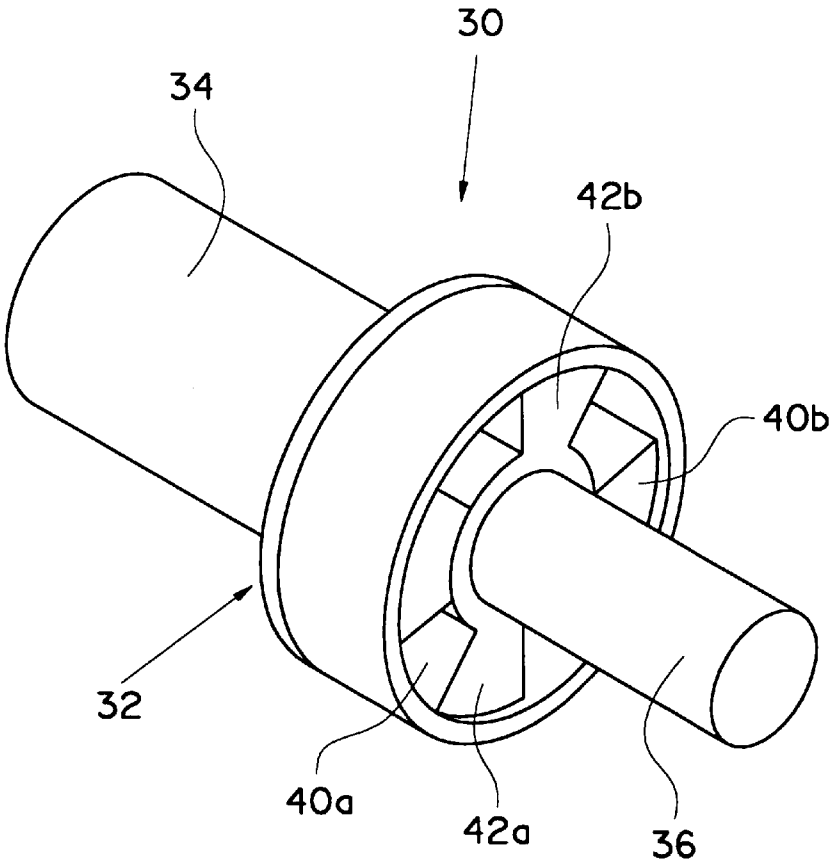
FIG. 3 is a schematic fragmentary perspective view of an arrowrest motion mechanism in accordance with another preferred embodiment of the invention.

FIG. 3 illustrates an arrowrest motion mechanism, generally designated by the reference numeral 30, in accordance with another preferred embodiment of the invention. Such an arrowrest motion mechanism generally operates in the manner described above now employing a circumferential bore configuration. More specifically, the arrowrest motion mechanism 30 employs a rotary piston arrangement and includes a brake housing 32, an associated bushing 34, and a rotatable arrowrest support shaft 36, whereto an arrowrest (not shown) such as known in the art, may be attached in a manner such as also known in the art. A pair of stationary blocks 40*a* and 40*b*, respectively, are attached to the brake housing 32, while a pair of rotatable blocks, 42*a* and 42*b*, respectively, are attached directly or indirectly to the arrowrest support shaft 36. One or more reed valves 44 are appropriately situated, such as on the back of the brake housing 32.

To facilitate illustration and discussion, FIG. 3 does not show the brake house covering which would normally enclose the stationary blocks, 40*a* and 40*b*, and the rotatable blocks 42*a* and 42*b*. Also, it will be appreciated that the number, size and relative placement of the stationary and rotatable blocks can be appropriately selected such as to facilitate the desired motion of the associated arrowrest.

Figure 4:
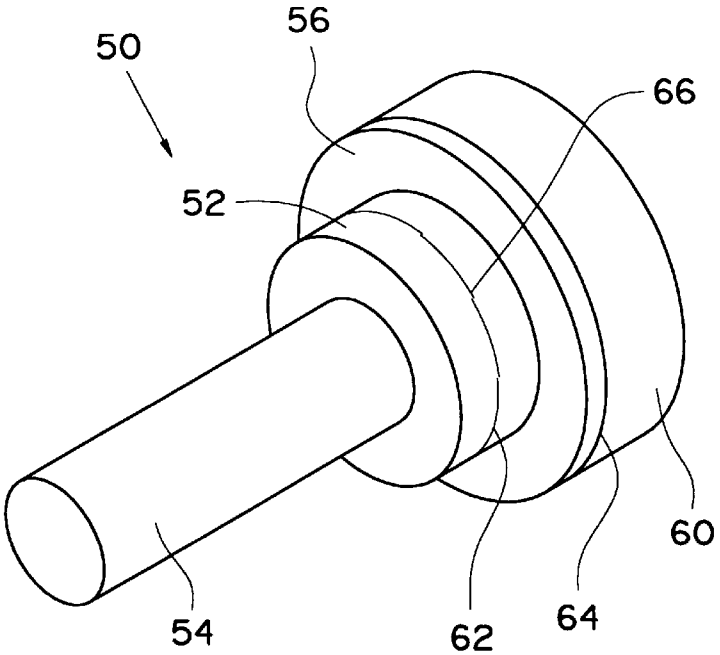
FIG. 4 is a schematic fragmentary perspective view of an arrowrest motion mechanism in accordance with yet another preferred embodiment of the invention.

FIG. 4 schematically illustrates an arrowrest motion mechanism, generally designated by the reference numeral 50, in accordance with yet another preferred embodiment of the invention. More specifically, the arrowrest motion mechanism 50 employs an arrangement which utilizes mechanical friction and a clutch to dampen the return of an associated arrowrest.

The arrowrest motion mechanism 50 includes a first ratchet plate 52, locked to a rotatable arrowrest support shaft 54, an adjacent rotating ratchet plate 56 and a non-rotating friction disk 60 such as on which a spring force, as is known in the art, may appropriately act. In accordance with the preferred practice of such embodiment, a low friction coefficient interface 62 is formed between the first ratchet plate 52 and the adjacent rotating rachet plate 56, while a high friction interface 64 is formed between the rotating ratchet plate 56 and the friction disk 60.

In such embodiment, a one-way clutch mechanism, such as schematically shown at 66, is coupled to a device that uses friction to slow the return rate of the arrowrest as it returns to the normal position. As will be appreciated, such an arrowrest motion mechanism may include both single or multiple plate disc type friction brakes. It also may include drum type brakes whereby an internal or external shoe presses against a cylindrical surface to create friction and a corresponding braking effect. Further, the plate or shoe pressure may either be adjustable or preset.

Figure 5:
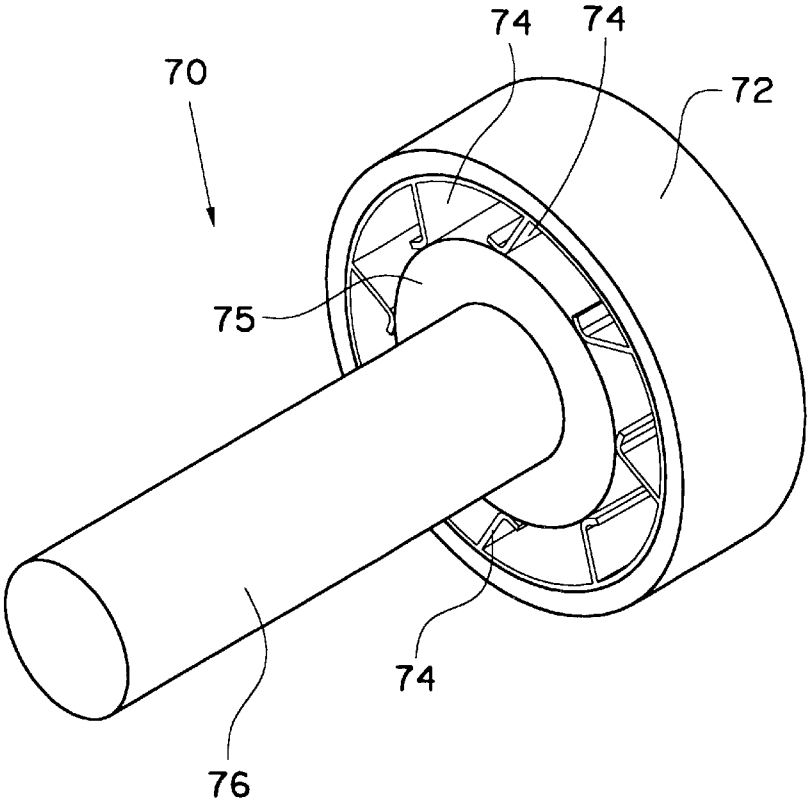
FIG. 5 is a schematic fragmentary perspective view of an arrowrest motion mechanism in accordance with still another preferred embodiment of the invention.

FIG. 5 schematically illustrates an arrowrest motion mechanism, generally designated by the reference numeral 70, in accordance with still another preferred embodiment of the invention. More specifically, the arrowrest motion mechanism 70 employs an arrangement which relies on an asymmetric application of friction to dampen the return of an associated arrowrest.

The arrowrest motion mechanism 70 includes a stationary housing 72, having a plurality of asymmetric springs 74 in interacting communication with a friction cylinder 75 mounted or secured to a rotatable arrowrest support shaft 76. The asymmetric springs 74 are designed to provide or result in a greater frictional force upon the return rate of motion of the associated arrowrest as compared to the discharge rate of motion thereof. As will be appreciated, asymmetric springs utilized in such embodiment of the invention can take various appropriate forms and thus the broader practice of the invention is not to be construed as limited to the specifically illustrated form of asymmetric spring.

Figure 6:
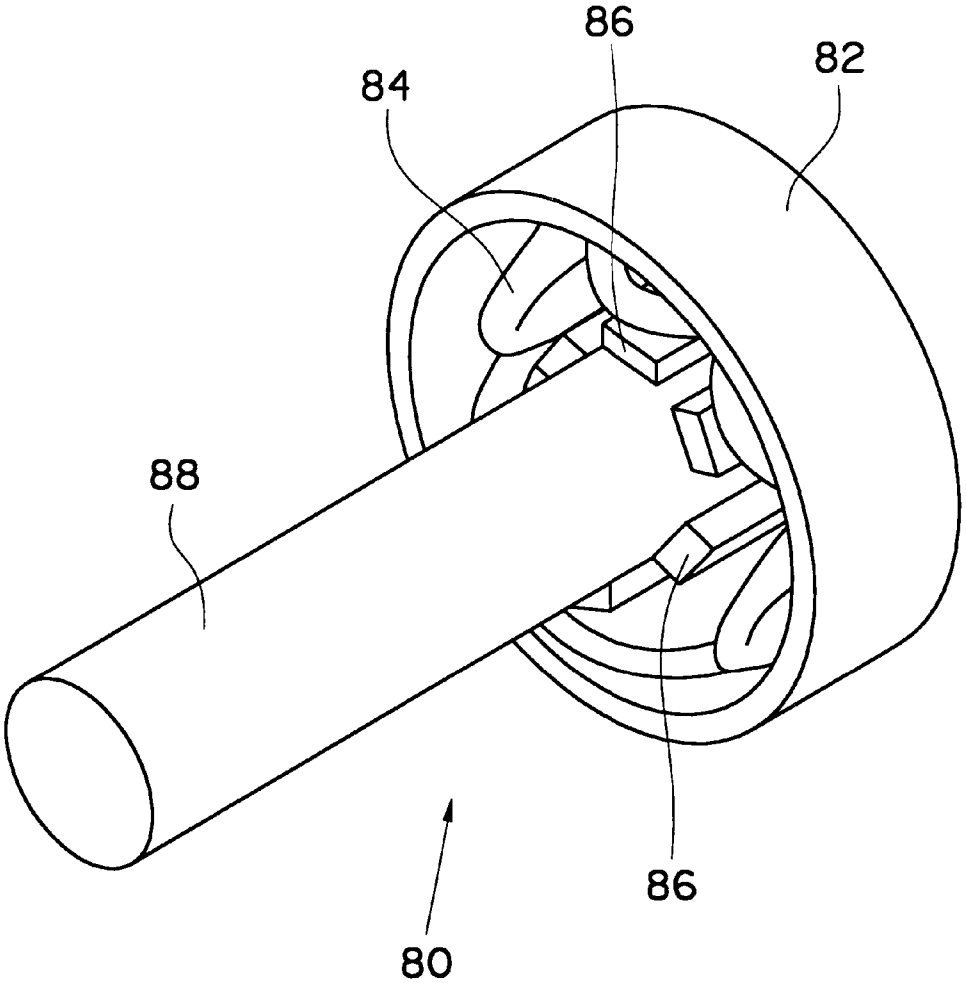
FIG. 6 is a schematic fragmentary perspective view of an arrowrest motion mechanism in accordance with yet still another preferred embodiment of the invention.

FIG. 6 schematically illustrates an arrowrest motion mechanism, generally designated by the reference numeral 80, in accordance with yet still another preferred embodiment of the invention. More specifically, the arrowrest motion mechanism 80 employs an arrangement which relies on the selective application of electromotive force to dampen the return of an associated arrowrest.

The arrowrest motion mechanism 80 includes a DC generator housing 82 containing a diode-including armature 84 in interacting communication with a plurality of permanent magnets 86 mounted or otherwise secured to a rotatable arrowrest support shaft 88. In such an arrowrest mechanism, the diode generally allows current flow in the armature in one direction but not the other. As a result, back electromotive force may be utilized to dampen or slow the return rate of motion of the rotatable arrowrest support shaft 88 and, in turn, the arrowrest associated therewith.

Figure 7:
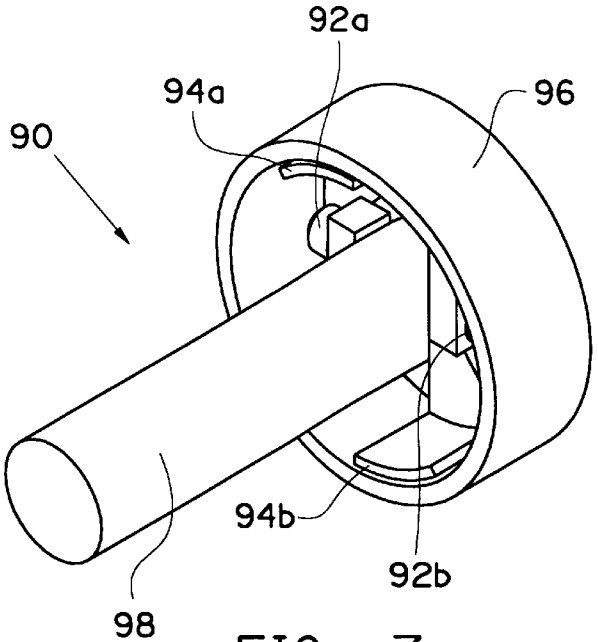
FIG. 7 is a schematic fragmentary perspective view of an arrowrest motion mechanism in accordance with an additional preferred embodiment of the invention.
Figure 8:
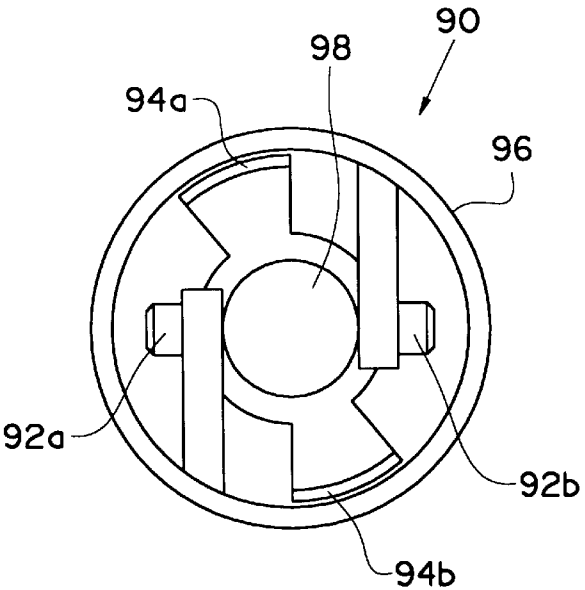
FIG. 8 is an end view of the arrowrest motion mechanism of FIG. 7.
Figure 9:
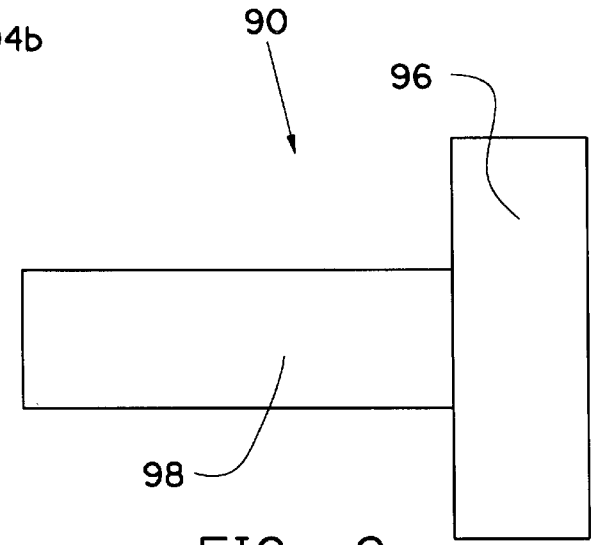
FIG. 9 is a side view of the arrowrest motion mechanism of FIG. 7.

FIGS. 7–9 illustrate an arrowrest motion mechanism 90 in accordance with an additional preferred embodiment of the invention. More specifically, the arrowrest motion mechanism 90 employs an arrangement which relies on the selective application of magnetic friction to dampen the return of an associated arrowrest.

In the arrowrest motion mechanism 90, a pair of floating magnets 92*a* and 92*b*, respectively, interact with steel or other appropriately selected magnetic material brake surfaces, 94*a* and 94*b*, respectively, within an associated housing 96 to dampen or slow the return rate of motion of the rotatable arrowrest support shaft 98 and, in turn, the arrowrest associated therewith. In such mechanism, the magnets are typically set at a given distance from an associated material that can be attracted magnetically, e.g., the seel brake surfaces. As the distance between the respective associated magnet and steel brake surface decreases, the magnetic force increases effecting an increased dampening rate. As the distance between a respective associated magnet and steel brake surface increases, the magnetic force decreases effecting a decreased dampening rate or greater rate of motion.

As will be appreciated, such an arrowrest motion mechanism may be practiced utilizing various specific constructions, as may be desired. For example, one or more of the floating magnets may be secured to the rotatable arrowrest support shaft while the associated steel brake surface is fixed to the housing. Alternatively, one or more of the magnets may be secured to the housing while the associated steel brake surface is joined to the housing. Further, various combinations of such arrangements may, if desired, be used.

Figure 1:
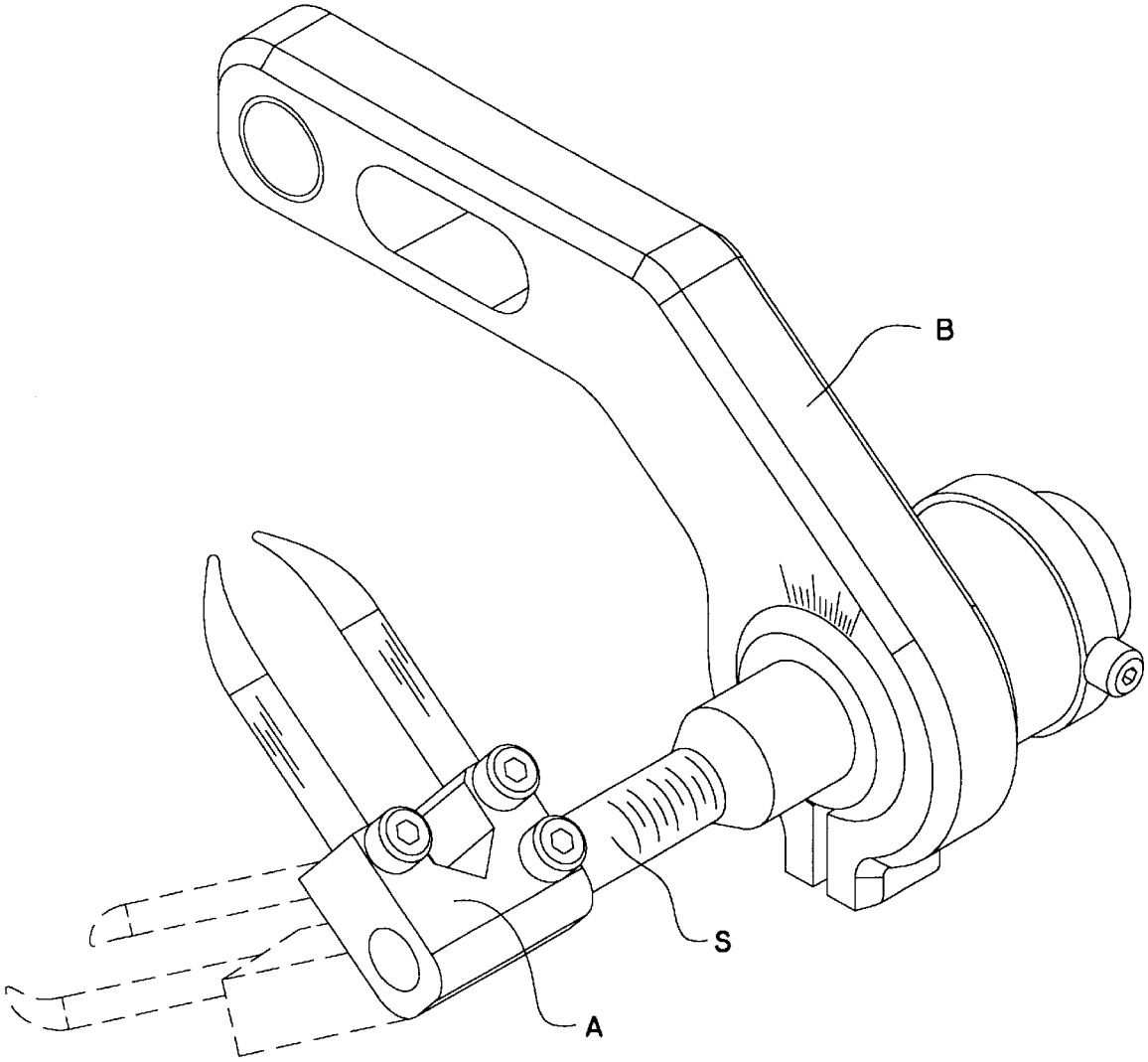
FIG. 1 (PRIOR ART)
FIG. 1 is a fragmentary perspective view of an arrowrest and associated mounting apparatus, as is know in the art.

It is to be understood that the subject arrowrest motion dampening mechanisms are generally not limited to use with particular forms or types of arrowrests. For example, the subject arrowrest motion dampening mechanisms are generally adaptable for inclusion on all of the popular arrowrest types available at this time. These include torsion type arrowrests, such as shown in FIG. 1, whereby the arrow supports are attached to a rotary pivot having a rotational axis 90 degrees to cylindrical centerline of the arrow shaft. These also include torsion type arrowrests whereby the arrow supports are attached to a rotary pivot having a rotational axis generally parallel to the cylindrical centerline of the arrow shaft. These embodiments are also clearly adaptable to shifting parallelogram torsion type arrowrests.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In an arrowrest for an archery bow having a first normal position and a second actuated position, the improvement comprising an arrowrest motion mechanisms the arrowrest attachable to a support shaft, and the support shaft movable between the first position and the second position, wherein the arrowrest motion mechanism provides for movement of the support shaft with a rate of motion from the first position to the second position greater than a rate of return motion from the second position to the first position.

2. The improved arrowrest of claim 1 wherein the arrowrest motion mechanism includes a frictional interface clutch.

3. The improved arrowrest of claim 1 wherein friction is asymmetrically applied on motion of the arrowrest from the first position to the second position as compared to a return motion of the arrowrest from the second position to the first position.

4. The improved arrowrest of claim 3 wherein the arrowrest motion mechanism comprises a plurality of springs having a first coefficient of friction on the return motion greater than a second coefficient of friction on motion from the first position to the second position.

5. The improved arrowrest of claim 1 wherein the arrowrest motion mechanism comprises an armature that produces an electromagnetic force which is selectively applied upon motion of the arrowrest.

6. In an arrowrest for an archery bow having a first normal position and a second actuated position, the improvement comprising an arrowrest motion mechanism; the arrowrest attachable to a support shaft, and the support shaft movable between the first position and the second position, wherein the arrowrest motion mechanism provides for movement of the support shaft with a rate of motion greater from the first position to the second position than a rate of return motion from the second position to the first position, and wherein the arrowrest motion mechanism includes a piston movable within a bore and means for controlling the rate of motion of the piston within the bore.

7. The improved arrowrest of claim 6 wherein at least the rate of return motion is adjustable.

8. The improved arrowrest of claim 6 wherein the means for controlling the rate of motion of the piston within the bore comprises a dampening fluid acting on the piston.

9. The improved arrowrest of claim 8 wherein the dampening fluid comprises a gas.

10. The improved arrowrest of claim 9 wherein the dampening fluid gas is air.

11. The improved arrowrest of claim 8 wherein the dampening fluid comprises a liquid.

12. The improved arrowrest of claim 11 wherein the dampening fluid liquid comprises at least one alcohol material.

13. The improved arrowrest of claim 6 wherein the piston is linearly mounted within the bore.

14. The improved arrowrest of claim 6 wherein the piston is rotationally mounted within the bore.

* * * * *